US005728961A

United States Patent [19]

Tamura

[11] Patent Number: 5,728,961

[45] Date of Patent: Mar. 17, 1998

[54] METHOD AND DEVICE FOR EXECUTING TONE GENERATING PROCESSING DEPENDING ON A COMPUTING CAPABILITY OF A PROCESSOR USED

[75] Inventor: Motoichi Tamura, Hamamatsu, Japan

[73] Assignee: Yamaha Corporation, Japan

[21] Appl. No.: 731,414

[22] Filed: Oct. 15, 1996

[30] Foreign Application Priority Data

Oct. 20, 1995 [JP] Japan ..... 7-297871

[51] Int. Cl.[6] ..... G10H 7/00

[52] U.S. Cl. ..... 84/600; 84/603; 84/630; 84/662

[58] Field of Search ..... 84/600, 601, 603, 84/609, 626, 630, 661, 662

[56] References Cited

U.S. PATENT DOCUMENTS 5,020,410 6/1991 Sasaki .
5,119,710 6/1992 Tsurumi et al. .
5,286,910 2/1994 Hasebe ..... 84/609
5,319,151 6/1994 Shiba et al. .
5,374,776 12/1994 Saito et al. ..... 84/627
5,376,752 12/1994 Limberis .
5,432,293 7/1995 Nonaka .
5,554,814 9/1996 Nakata ..... 84/659

FOREIGN PATENT DOCUMENTS 0 597 381 5/1994 European Pat. Off. .
0 702 348 3/1996 European Pat. Off. .

*Primary Examiner*—William M. Shoop, Jr.
*Assistant Examiner*—Jeffrey W. Donels
*Attorney, Agent, or Firm*—Graham & James LLP

[57] ABSTRACT

In a tone generating method or device, where an arithmetic unit such as a CPU or DSP is used to execute a specific tone generating processing program to generate tone signals, control is conducted to execute the tone generating processing with its content controlled to be most suitable for the computing capability of the arithmetic unit. Namely, performance or computing capability of the arithmetic unit is detected prior to execution of the tone generating processing, and depending on the detected performance, control is conducted to modify the content of the tone generating processing so as to best fit the performance.

24 Claims, 8 Drawing Sheets

METHOD AND DEVICE FOR EXECUTING TONE GENERATING PROCESSING DEPENDING ON A COMPUTING CAPABILITY OF A PROCESSOR USED

BACKGROUND OF THE INVENTION

The present invention relates generally to tone generating techniques, and more particularly to an improved tone generating technique which permits control over content of tone generating processing depending on the computing capability of an arithmetic unit employed for that processing.

Many of the electronic musical instruments known today have their microprocessors execute programs describing various processing such as for generating a tone waveform and imparting an effect to the generated tone waveform (hereinafter, these processing will be collectively referred to as tone generating processing). It was long been a common practice to implement such microprocessors by dedicated LSIs such as tone generator LSIs or DSPs (digital signal processors).

By virtue of the recent improvement in computing capability of CPUs, electronic musical instruments have been developed where tone generating programs are executed by a CPU of a general-purpose computer or a CPU provided within the musical instrument. Tone generating methods and devices arranged in this manner will hereinafter be referred to as CPU tone generators or software tone generators.

Such software tone generators generally employ one of two waveform generating computation methods; the one method is for generating only one sample of waveform data per computation, while the other method is for generating plural samples of waveform data per computation. The other or second-mentioned waveform generating computation method is more advantageous than the first-mentioned method in that it permits more efficient data access to and from a memory and hence higher-speed computation. Further, in such software tone generators, there is employed one of two methods for generating tone waveform data in a plurality of tone generating channels; the one method is for constantly executing tone waveform data generating computation for a predetermined number of the channels, while the other method is for executing tone waveform data generating computation only for any of the channels that is currently sounding a tone. The second-mentioned tone waveform data generating method is more advantageous than the first-mentioned in that it can effectively minimize an amount of computation to be performed by the CPU.

In the software tone generators, however, predetermined tone generating processing programs prestored in memory are not always executed by a CPU of same computing capability. Namely, any general-purpose computers may be used in connection with the tone generators as long as they are compatible (i.e., have a same type of arithmetic units), but the computing capabilities of CPUs contained within individual computers do differ depending on the types of the computers and the times when the computers were developed. In cases where tone generating processing programs are executed by CPUs in electronic musical instruments, if the programs are written separately for each type of the electronic musical instrument, the likelihood of the programs being executed by CPUs of different computing capabilities is eliminated. Actually, however, in many of such cases, a mask ROM storing the tone generating processing programs is used in common for a plurality of types of the electronic musical instruments to minimize costs, so that the same programs are very likely to be executed by the CPUs of different computing capabilities.

Various problems would result where same tone generating processing programs are shared among the CPUs of different computing capabilities in the above-mentioned manner. For example, if tone generating processing programs created for a specific CPU responsive to a given operation clock are executed by another CPU responsive to a slower operation clock, the number of tones capable of being simultaneously generated via the CPU becomes smaller, which would often result in significant inconveniences in performance. Such inconveniences could take place in the above-mentioned method that executes tone waveform data generating computation only for any of the channels currently sounding a tone. Conversely, if tone generating processing programs created for a specific CPU is executed by another CPU responsive to a faster operation clock, then there would occur a problem that the computing capability of the CPU can not be fully utilized in tone generation.

Further, which sort of instructions composing tone generating processing programs can be executed at high speed generally depends on a particular type of a CPU employed for the processing. For example, while CPUs of the type containing an arithmetic processor can execute floating-point arithmetic operations at high speed, CPUs of the type not containing such an arithmetic processor take more time to execute floating-point arithmetic operations. Thus, if tone generating processing programs composed of instructions suitable for high-speed operation of a specific type CPU are executed by another type CPU, too much time are spent in tone generation, which would also result in significant inconveniences in performance.

SUMMARY OF THE INVENTION

It is therefore an object of the present invention to provide a tone generating method and device which are capable of generating tones of highest possible quality by executing tone generating processing with content most suitable for the computing capability of a CPU employed for that processing.

Note that in this specification, various factors determining a computing capability of an arithmetic unit or processor device such as a CPU (e.g., operation clock, presence/absence of an arithmetic processor, instruction and data cache memories in the arithmetic unit) will be called "performance" of the processor device.

In order to accomplish the above-mentioned object, a tone generating device according to a first aspect of the present invention is of the type using a processor device to execute tone generating processing and comprises a detecting section for detecting performance of the processor device, and a control section for, depending on the performance detected by the detecting section, controlling content of the tone generating processing to be executed by the processor device, wherein the processor device executes the tone generating processing with the content controlled by the control section.

In the tone generating device according to the first aspect, the performance of the processor device is detected by the detecting section prior to execution of the tone generating processing, and depending on the detected performance, the control section controls the content of the tone generating processing. Then, tones are generated by the processor device executing the tone generating processing with the thus-controlled content. Because the content of the tone generating processing is controlled depending on the detected performance of the processor device, tones of highest possible quality can be generated by just executing the processing in a manner most suitable for the processor device.

In a preferred example, if the performance of the processor device detected by the detecting section is below a predetermined level, the control section executes at least one of control for setting the tone generating processing to a relatively low grade and control for omitting execution of a part of the tone generating processing. Thus, even where the processor device used has a low computing capability (e.g., based on a slow operation clock), time required for the processing in a specific one of tone generating channels is effectively reduced, so that a sufficient number of tones can be generated simultaneously. In another preferred example, the control section executes control such that depending on the performance detected by the detecting section, different instructions are used as instructions composing a tone generating processing program. Thus, depending on the detected performance of the processor device (e.g., whether or not the processor device contains a specific arithmetic processor), the tone generating processing can be executed at high speed, using a sort of instructions optimal for high-speed operation of the processor device used.

A tone generating device according to a second aspect of the present invention is of the type using a processor device to execute tone generating processing and comprises a detecting section for detecting performance of the processor device, an operator section for selecting control data to be inputted to the device so as to control content of the tone generating processing to be executed by the processor device, and a designating section for, depending on the performance detected by the detecting section, designating a range of the control data that can be selected via the operator section, wherein the processor device executes the tone generating processing with the content controlled by the control data selected via the operator section.

This tone generating device is similar to the first-aspect tone generating device in that performance of the processor device is detected by the detecting section prior to execution of the tone generating processing, but different in that it includes the operator section for inputting control data for controlling the content of the tone generating processing and a range of the control data capable of being inputted or selected via the operator section is designated by the designating section. Tones are generated by the processor device executing the tone generating processing with the content controlled by the control data inputted via the operator section within the range designated by the designating section. Because the selectable range of the control data is designated depending on the detected performance of the processor device and the tone generating processing is executed with the content controlled by the control data inputted within the designated range, tones of highest possible quality can be generated by executing the processing in a manner most suitable for the processor device.

A tone generating device according to a third aspect of the present invention comprises a general-purpose processor device for executing tone generating processing in accordance with a program describing the processing, a detecting section for detecting performance of the processor device, and a control section for, depending on the performance detected by the detecting section, controlling content of the tone generating processing executed by the processor device in accordance with the program.

In the tone generating device thus arranged, performance of the general-purpose processor device executing a tone generating processing program is detected by the detecting section prior to execution of the tone generating processing, and depending on the detected performance, the control section controls the content of the tone generating processing actually executed in accordance with the program. Tones are generated by the processor device executing the tone generating processing with the content thus controlled. Consequently, tones of highest possible quality can be generated by executing the processing in a manner most suitable for the general-purpose processor device.

Further, the present invention provides a method for generating a tone signal by causing a general-purpose processor device to execute a program describing predetermined tone generating processing, which method comprises a first step of causing the processor device to detect performance of the processor device, a second step of causing the processor device to execute a process for, depending on the performance detected by the first step, controlling content of the tone generating processing to be executed by the processor device; and a third step of causing the processor device to execute the tone generating processing with the content controlled by the second step.

In the tone generating method thus arranged, performance of the general-purpose processor device detects its performance prior to execution of the tone generating processing, and depending on the detected performance, the processor device controls the content of the tone generating processing to be executed. Tones are generated by the processor device executing the tone generating processing with the content thus controlled. Consequently, tones of highest possible quality can be generated by executing the processing in a manner most suitable for the general-purpose processor device.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
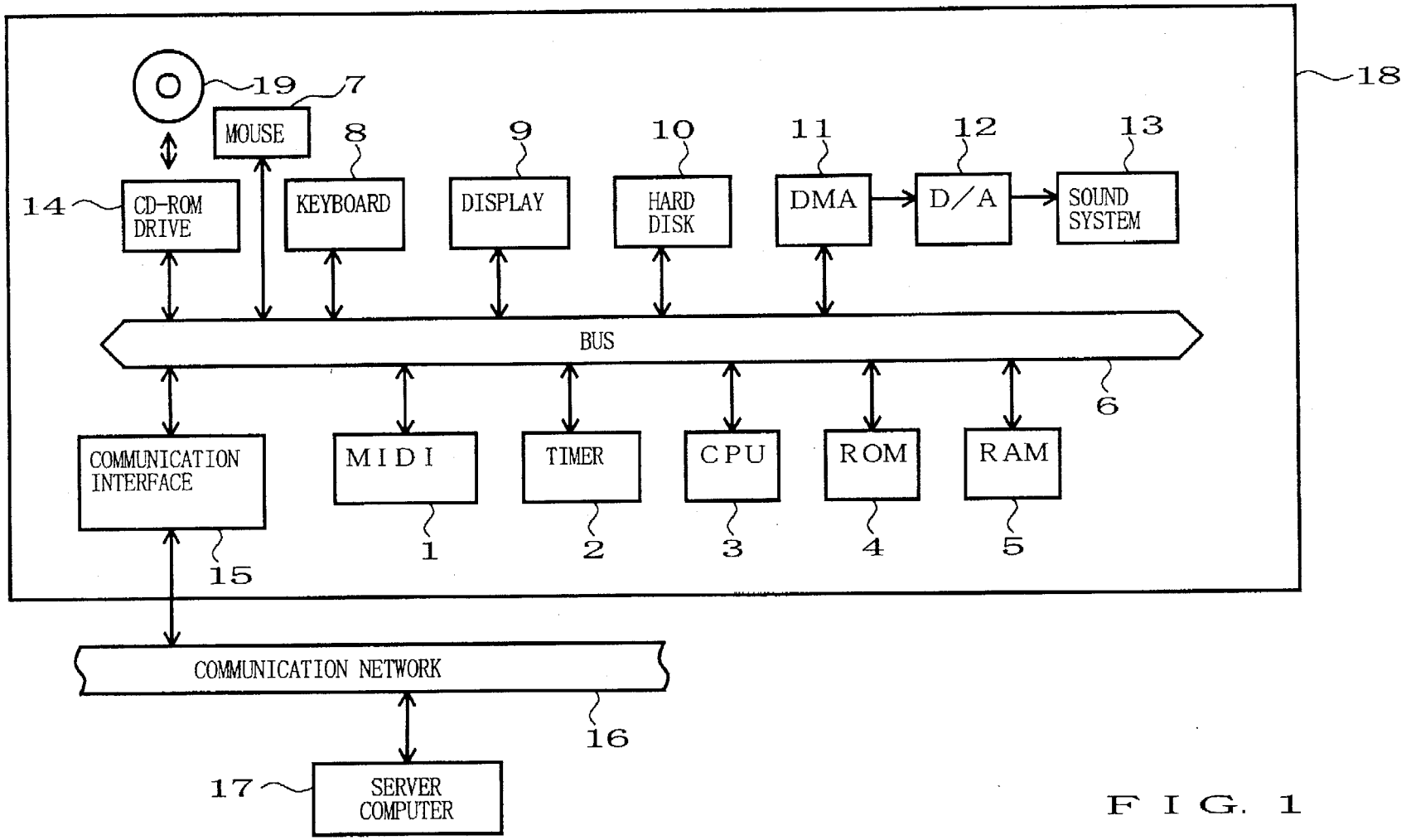
FIG. 1 is a block diagram illustrating a general structure of a computer music system to which is applied the principle of the present invention.

FIG. 1 is a block diagram illustrating a general structure of a computer music system 18 based on a software tone generator according to the present invention, in which a CPU 3 of a personal computer executes tone generating processing.

To the CPU 3 are connected, via a data and address bus 6, a MIDI interface 1, a timer 2, a ROM (read-only memory) 4, a RAM (random-access memory) 5, a mouse 7, a keyboard 8, a display 9, a hard disk device 10 and a DMA (direct memory access) circuit 11. MIDI (musical instrument digital interface) performance information is supplied from a sequencer (not shown) or the like to the MIDI interface 1.

The hard disk device 10 has prestored thereon various programs (including tone generating processing programs), as well as waveform data of a plurality of tone colors for one or more periods (e.g., waveform data in PCM (pulse code modulation) form).

The DMA circuit 11 executes a reproduction process, in which it uses the known direct memory access method to sequentially read out from the RAM 5 tone data generated by the CPU 3 executing the tone generating processing and then sends the read-out tone data to a D/A (digital-to-analog) converter 12. The DMA circuit 11 executes this reproduction process, at controlled timing corresponding to a reproduction sampling frequency (e.g., 48 kHz) of the D/A (digital-to-analog) converter 12, on a predetermined number of samples (e.g., 128 samples) of the tone data in each predetermined short period—thus, 128 samples of the tone data can be said to be a single processed unit—. Each of the tone data converted via the D/A converter 12 into analog representation is audibly reproduced via a sound system 13 comprised of amplifiers and speakers.

The programs to be executed by the CPU 3 may be prestored in the ROM 4 rather than on the hard disk 10, there may be stored various other data than the waveform data. By loading any of the programs from the hard disk 10 or ROM 4 into the RAM 5, the CPU 3 can execute the program. This greatly facilitates version-up, addition, etc. of an operating program. A CD-ROM (compact disk) 19 may be used as a removably-attachable external recording medium for recording various data and an optional operating program. Such an operating program and data stored in the CD-ROM 19 can be read out by means of a CD-ROM drive 14 to be then transferred for storage on the hard disk 10. This facilitates installation and version-up of the operating program. The removably-attachable external recording medium may be other than the CD-ROM, such as a floppy disk and magneto optical disk (MO).

A communication interface 15 may be connected to the bus 6 so that the computer music system 18 can be connected via the interface 15 to a communication network 16 such as a LAN (local area network), internet and telephone line network and can also be connected to an appropriate sever computer 17 via the communication network 16. Thus, where the operating program and various data are not stored on the hard disk 10, these operating program and data can be received from the server computer 17 and downloaded onto the hard disk 8. In such a case, the computer music system 18, i.e., a "client", sends a command requesting the server computer 17 to download the operating program and various data by way of the communication interface 15 and communication network 16. In response to the command from the computer music system 18, the server computer 17 delivers the requested operating program and data to the system 18 via the communication network 16. The computer music system 18 completes the necessary downloading by receiving the operating program and data via the communication network 15 and storing these onto the hard disk 10.

It should be understood here that the computer music system 18 of the present invention may be implemented by installing the operating program and various data corresponding to the present invention in a commercially available personal computer. In such a case, the operating program and various data corresponding to the present invention may be provided to users in a recorded form in a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

Figure 2:
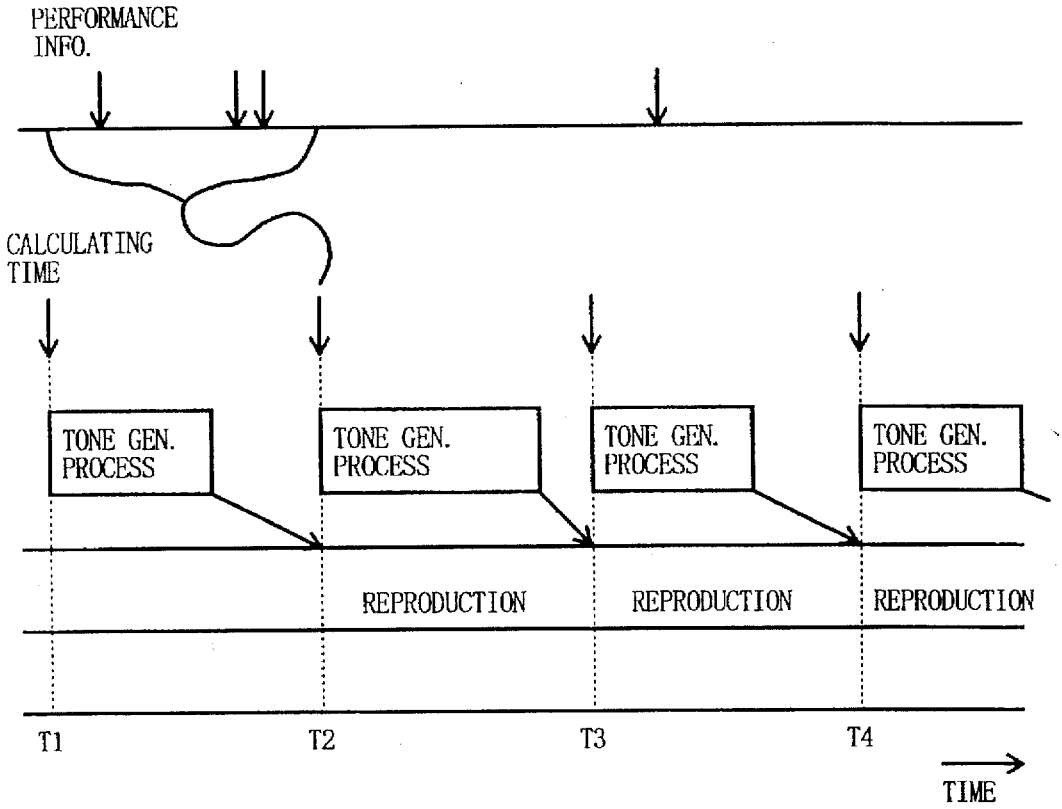
FIG. 2 is a diagram illustrating a basic functional principle of a software tone generator employed in the computer music system of FIG. 1.

FIG. 2 is a diagram illustrating a basic functional principle of the software tone generator employed in the computer music system 18. On the basis of performance information received via the MIDI interface 1 in each predetermined time section having a predetermined length, the CPU 3 executes the tone generating processing in the next time section. In the example of FIG. 2, the tone generating processing is first executed by the CPU 3 in a time section from time T2 to time T3 on the basis of performance information received in a preceding time section from time T1 to time T2. Alternatively, the tone generating processing based on performance information received over a predetermined number of successive time sections may be executed collectively in a subsequent single time section. Further, whether the tone generating processing based on performance information received over a predetermined number of successive time sections should be executed collectively or not may be determined variably in accordance with the passage of time. Tone data thus generated via the CPU 3 in each time section are then reproduced by the DMA circuit 11 over an entire time section immediately following that time section; namely, in the example of FIG. 2, tone data generated in a time section from time T2 to time T3 are reproduced over an entire time section from time T3 to T4. Thus, the length of each of the time sections is equal to the product between the number of samples processed by the DMA circuit 11 as a single processed unit and the sampling period of the D/A converter 12, which in the example of FIG. 2 is about 0.0027 sec (128÷48,000).

Because the reproduction process by the DMA circuit 11 has to be conducted successively in order to generate a tone without a break, a single processed unit of tone data to be reproduced in each of the time sections by the DMA circuit 11 must have already been generated completely in the preceding time section. With the conventional software tone generators, computing capabilities of CPUs used for execution of the tone generating processing tend to greatly differ from each other, and thus there would be encountered a problem that generation of tones for a sufficient number of the tone generating channels can not be completed within a single time section or time taken for the tone generation extends beyond the length of a time section. In view of such a problem presented by the conventional software tone generators, the computer music system of the invention is designed to permit execution of tone generating processing with content most suitable for the computing capability of each CPU used. A detailed description will now be made about exemplary operation of the computer music system with reference to the drawings.

Figure 3:
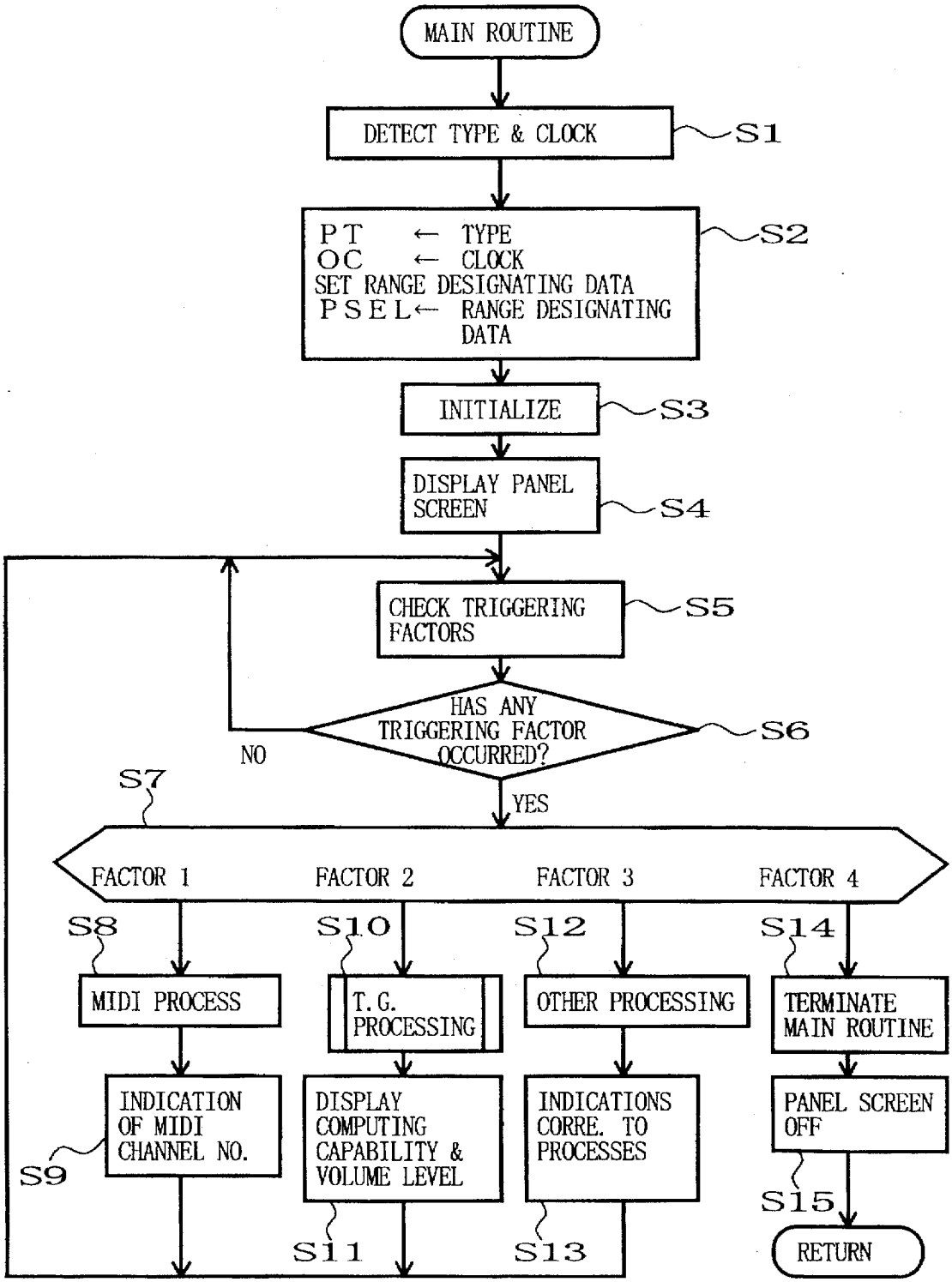
FIG. 3 is a flowchart of a main routine executed by a CPU of the computer music system of FIG. 1.

FIG. 3 is a flowchart of a main routine executed by the CPU 3. In this main routine, at first step S1, the operation clock and type of the CPU to be used for execution of the tone generating processing (in this case, CPU 3) are detected as information representing the performance of the CPU. The operation clock of the CPU 3 may be detected by actually counting the operation clock pulses.

The type of the CPU 3 may be detected, for example, by executing any one of the existing test programs. More specifically, examples of the existing test programs include one for detecting a type of each CPU commercially available from Intel Corporation, U.S.A. which is designed to distinguish a 32-bit CPU from 16-bit CPUs such as "Intel 8086" and "Intel 80286" (both trademarks of Intel Corporation, U.S.A.) on the basis of differences in respective flag settings stored in response to interrupt instructions or the like, and one which is designed to distinguish 32-bit "Intel 80486" and "Pentium" (both trademarks of Intel Corporation, U.S.A.) CPUs from "Intel 80386" CPU on the basis of differences in stored values in respective EFLAG registers. In view of the fact that the above-mentioned "Pentium" CPU contains an arithmetic processor for floating-point arithmetic operations while the "Intel 80486" does not contain such an arithmetic processor, another test program is developed which is designed to distinguish between the "Pentium" and "Intel 80486" CPUs by writing into status and control word registers in response to FNINIT instructions and then determining whether or not correct values can be read out from the registers.

In stead of executing the test program, data indicative of the operation clock and type of the CPU used may be prestored in a specific storing region accessible by the CPU so that the data are read out from the region at step S1.

Once the operation clock and type of the CPU are detected at step S1, the data indicative of the detected operation clock and type are stored into respective registers OC and PT and also range designating data is set to designate a selectable range of control data to be used for controlling the content of the tone generating processing and stored into register PSEL, at step S2.

Generally, if the computing capability of the CPU 3 governed by its operation clock and type is above a predetermined level, range designating data is set to permit a selection of all predetermined control data; however, if the computing capability of the CPU 3 is below a predetermined level, range designating data is set to permit a selection of only some of the predetermined control data which have a relatively low grade. The detail of the range designating data will be described later in connection with step S4 along with the control data.

Figure 4:
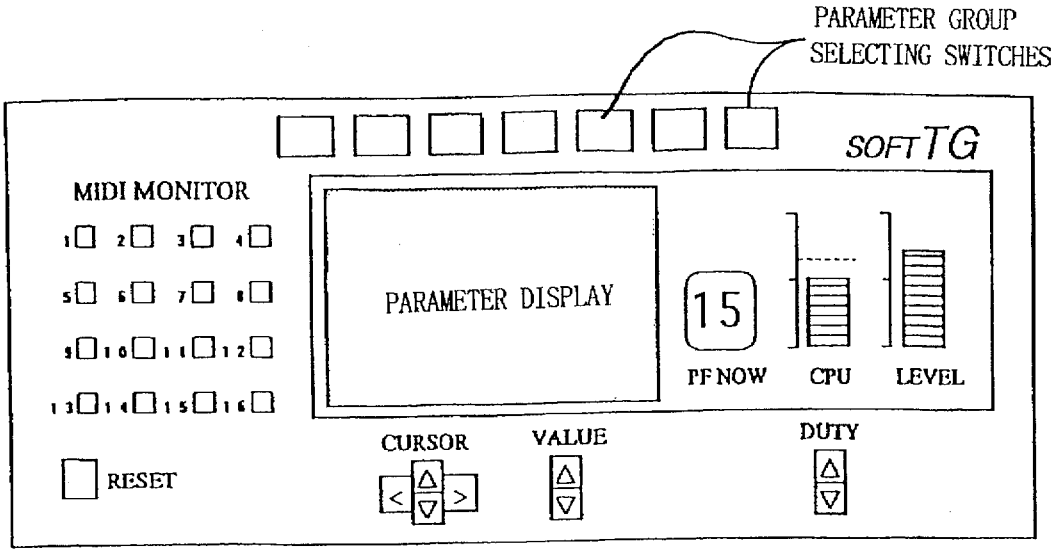
FIG. 4 is a diagram of a panel screen shown on a display of the computer music system.

After step S2, the CPU 3 executes a predetermined initialization process at step S3 and then at step S4 displays a panel screen on the display 9 as shown in FIG. 4.

In FIG. 4, parameter group selecting switches on the top of the panel screen are in the form of icons, each of which is provided for selecting one of parameter groups as the control data used for controlling the content of the tone generating processing: for example, the parameter groups includes one used for controlling the sampling frequency at which original waveform data are read out (hereinafter referred to as a sampling-frequency controlling parameter group), one used for controlling interpolation between the read-out samples of the original waveform data (hereinafter referred to as an interpolation controlling parameter group), and one used for controlling a process to impart a tonal effect, such as reverberation or chorus, to generated waveform data (hereinafter referred to as effect-impartment controlling parameter group). The parameter group selected by operation of a specific one of the parameter group selecting switches is displayed on a parameter display section in the central portion of the panel screen.

A cursor switch labelled "CURSOR" on the bottom of the panel screen of FIG. 4 is also in the form of an icon and provided for moving a cursor to point to and select a specific one of the parameters (i.e., parameter group) displayed on the parameter display section; for example, the interpolation controlling parameter group includes three different parameters, "non-interpolation", "two-point interpolation" and "four-point interpolation". A value switch labelled "VALUE" to the right of the cursor switch in FIG. 4 is also in the form of an icon and provided for setting a value of each control data displayed on the parameter display section.

By operating these switches via the mouse 7, the user can selectively input specific control data within a selectable range designated by the range designating data stored in the register PSEL. Consider a case where the sampling-frequency controlling parameter group includes three different parameters, "12 kHz", "24 kHz" and "48 kHz". If the operation clock of the CPU 3 is faster than a predetermined rate, all the three sampling-frequency controlling parameters are displayed for selection in response to a user's selection via the corresponding parameter group selecting switch (namely, all the three parameters are selectable in this case). If the operation clock of the CPU 3 is slower than a predetermined rate, only two of the parameters, "12 kHz" and "24 kHz", are displayed, or all the three parameters are displayed with a selection of the "48 kHz" parameter disabled. If the operation clock of the CPU 3 is further slower, only the "12 kHz" parameter is displayed, or all the three parameters are displayed with a selection of the "24 kHz" and "48 kHz" parameters disabled.

In the case of the interpolation controlling parameter group, all the three parameters, "non-interpolation", "two-point interpolation" and "four-point interpolation", are displayed for selection if the operation clock of the CPU 3 is faster than a predetermined rate. However, if the operation clock of the CPU 3 is slower than a predetermined rate, only two of the parameters, "non-interpolation" and "two-point interpolation", are displayed, or all the three parameters are displayed with a selection of the "four-point interpolation" parameter disabled. Even when the operation clock of the CPU 3 is very slow, it is desirable to permit a selection of the "non-interpolation" and "two-point interpolation" parameters, rather than the "two-point interpolation" parameter alone.

Further, consider a case where the effect-impartment controlling parameter group for controlling a process to impart a reverberation effect includes three different parameters, "off", "simplified reverberation" (i.e., low-grade reverberation achieved by executing a predetermined algorithm with parts omitted therefrom) and "standard reverberation" (high-grade reverberation achieved by executing the whole of the predetermined algorithm). Where the CPU 3 is of the type containing no arithmetic processor for floating-point arithmetic operations, none of the three parameters is displayed on the parameter display section, or the three parameters are displayed with a selection of the other two parameters than the "off" parameter disabled. On the other hand, where the CPU 3 is of the type containing an arithmetic processor for floating-point arithmetic operations, all the three parameters are displayed for selection as long as the operation clock of the CPU 3 is faster than a predetermined rate; however, if the operation clock of the CPU 3 is slower than a predetermined rate in this case, only the "off" and "simplified reverberation" parameters are displayed, or all the three parameters are displayed with a selection of the "standard reverberation" parameter disabled. Because presence/absence of a reverberation effect has a significant effect on the auditory sense of a listener, it is desirable to permit a selection of the "simplified reverberation" parameter even where the operation clock of the CPU 3 is slow.

Following step S4, the CPU 3 at step S5 checks to see whether there has occurred any of the following triggering factors:

Triggering factor 1: Writing of new received data into an input buffer in the RAM 5;

Triggering factor 2: Request for execution of the tone generating processing which is made in response to an interrupt signal given from the DMA circuit 11;

Triggering factor 3: Another request such as an input event on the panel screen of the display 9 or a command input event on the keyboard 8 (but excluding a main routine ending command); and Triggering factor 4: Main routine ending command on the keyboard 8.

Figure 5:
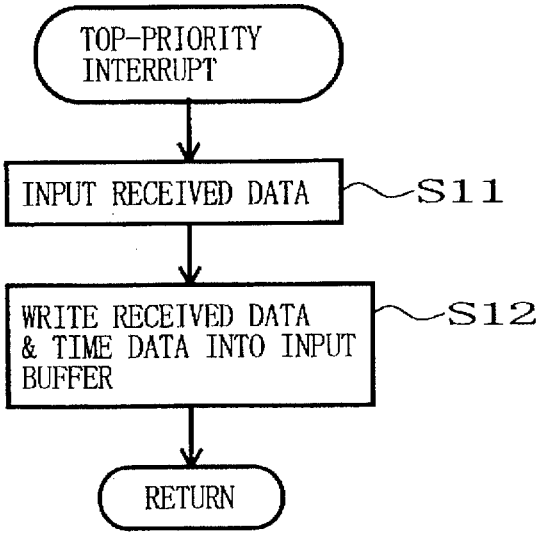
FIG. 5 is a flowchart of an interrupt process executed by the CPU of the computer music system.
Figure 6:
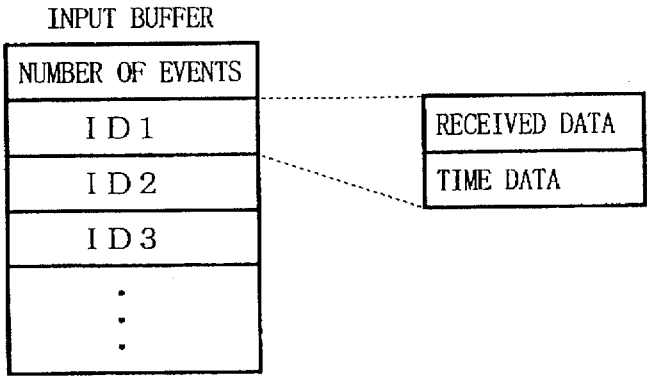
FIG. 6 shows examples of storing regions in an input buffer.

Writing of new received data into the input buffer in the RAM 5 defined as triggering factor 1 is effected by executing a top-priority interrupt process of FIG. 5 each time performance information is received via the MIDI interface 1. In the top-priority interrupt process of FIG. 5, the received performance information is input into the system at step S11 and written at step S12 into the input buffer of the RAM 5 along with time data indicative of a time when the information is received. Although received data are immediately written into the input buffer every time they are received, the tone generating processing based on the thus-written received data is not immediately executed (i.e., executed after the current time section as shown in FIG. 2), and hence the time data is written into the input buffer to identify an exact time when the corresponding data were received. FIG. 6 shows storing regions in the input buffer, where the number of received data is written in a storing region labelled "number of events" and the received data and their associated time data are written in storing regions labelled "ID1", "ID2", "ID3" . . .

Referring back to the main routine of FIG. 3, after step S5, a determination is made at step S6 as to whether any of the above-mentioned triggering factors has occurred. If answered in the negative as determined at step S6, the main routine reverts to step S5 in order to repeat the operations of steps S5 and S6 until any of the above-mentioned triggering factors occurs. Once any of the triggering factors has occurred, an affirmative determination results at step S6 and the main routine moves on to step S7, where a determination is made as to which of the triggering factors has occurred.

If triggering factor 1 has occurred, predetermined MIDI processing is executed at step S8 and an indication as to which of MIDI channel Nos. 1 to 16 the performance information has been received for is made at step S9 on a section labelled "MIDI MONITOR" provided in the left portion of the panel screen (FIG. 4). After this, the main routine loops back to step S5 in order to repeat the operations at and after step S5. The MIDI processing at step S8 includes note-on event and note-off processes based on note-on and note-off signals.

Figure 7:
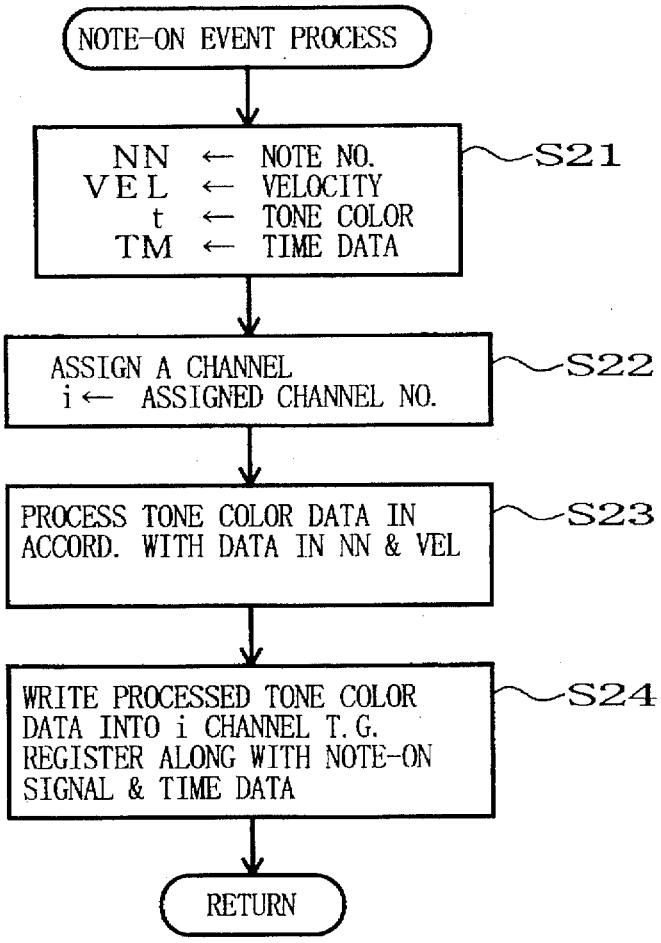
FIG. 7 is a flowchart illustrating a note-on event process executed by the CPU.
Figure 8:
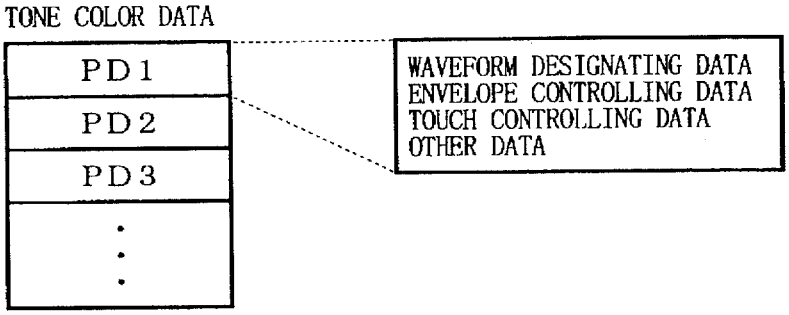
FIG. 8 is a diagram showing exemplary contents of tone color data.

FIG. 7 is a flowchart illustrating an example of the note-on event process. At first step S21, data indicative of a note number, velocity and tone color corresponding to a part associated with the MIDI channel and time data are read out from the input buffer and stored into respective registers NN, VEL, t and TM. At next step S22, one of the tone generating channels is assigned for generating a tone signal corresponding to the note number, and the number of the assigned channel is stored into register i. Then, at step S23, data of the tone color for the part are read out from a tone color data storing region of the RAM 5, and the read-out tone color data are processed in accordance with the note number and velocity stored in the registers NN and VEL. FIG. 8 shows exemplary contents of the tone color data stored in the tone color storing region of the RAM 5 after having been read out from the hard disk device 10. In the example of FIG. 8, each set of the tone color data PD1, PD2, . . . includes data designating a waveform of each range, envelope controlling data, data for controlling a tone volume, color and pitch depending on a detected touch, and various other data. Then, the tone color data processed at step S23 including pitch designating data (frequency number) are written at step S24 into a tone generator register provided for the tone generating channel of the channel number stored in the register i, after which the CPU returns to the main routine.

Figure 9:
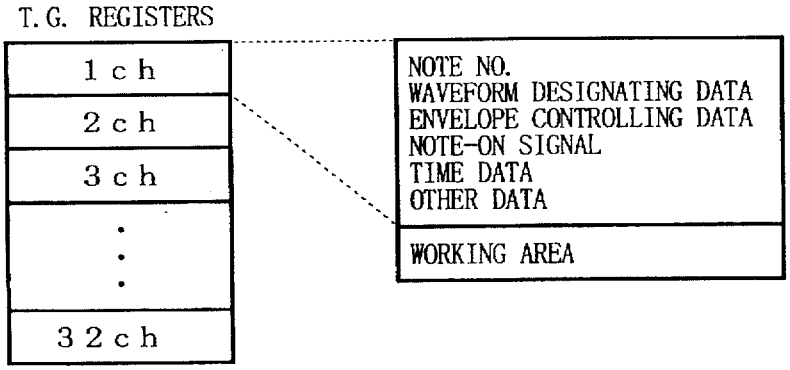
FIG. 9 is a diagram showing exemplary storing regions of tone generator registers.

FIG. 9 shows a manner in which the tone color data are stored in tone generator registers. In the example of FIG. 9, tone generator registers are provided for 32 tone generating channels, each of which has a region for storing a note number, waveform designating data, envelope controlling data, note-on data, time data and other data, and a working area. The other data include data indicative of an algorithm relating to an effect selected by use of the panel screen on the display 9.

Referring back to the main routine of FIG. 3, if triggering factor 2 has occurred as determined at step S7, tone generator processing is executed at step S10 as will be later described in detail, and the computing capability of the CPU 3 and volume level of a generated tone are displayed graphically in the right portion of the panel screen at respective places labelled "CPU" and "LEVEL". The computing capability displayed here represents a ratio, of part of the computing capability used for the tone generating processing of the software tone generator, to the total computing capability of the CPU. After step S11, the main routine loops back to step S5 in order to repeat the operations at and after step S5.

If triggering factor 3 has occurred as determined at step S7, other processing (including input event processes responsive to an input on the panel screen of the display 9 and a command input from the keyboard 8) is executed at step S12, after which predetermined indications corresponding to the individual processes are made on the panel screen of the display 9 at step S13. Then, the main routine loops back to step S5 in order to repeat the operations at and after step S5.

Figure 10:
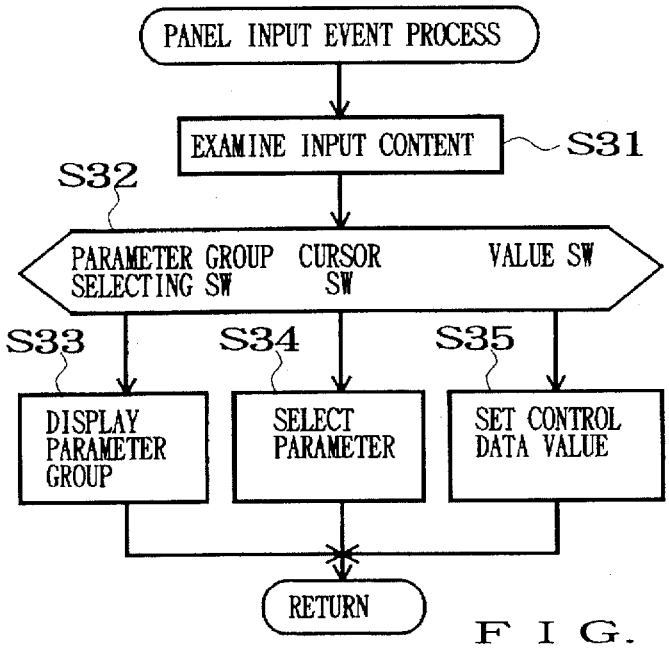
FIG. 10 is a flowchart illustrating a panel input event process executed by the CPU.

FIG. 10 is a flowchart illustrating an example of the panel input event process in the other processing. First, the content of the input data is examined at step S31, and a determination is made at step S32 as to on which of the switches the input event has occurred. If the input event has occurred on one of the parameter group selecting switches, the parameter group selected by the switch is displayed on the parameter display section of the panel screen at step S33, and the CPU returns to the main routine. If the input event has occurred on the cursor switch, one of the parameters in the group displayed on the parameter display section is selected at step S34 as dictated by the operation of the cursor switch, after which the CPU returns to the main routine. If the input event has occurred on the value switch, a value of the control data is set at step S35 as dictated by the operation of the value switch, after which the CPU returns to the main routine.

As previously noted in connection with step S4 of FIG. 3, the parameter group to be displayed on the parameter display section and selectable parameter range of the displayed parameter group are designated by the range designating data stored in the register PSEL.

Finally, if triggering factor 4 has occurred as determined at step S7 of the main routine, a predetermined process is executed at step S14 to terminate the main routine and the panel screen is caused to disappear from the display 9 at step S15, after which the CPU 3 returns. In case two or more of triggering factors 1–4 have occurred simultaneously as determined at step S7, the operations after step S7 are carried out in sequential order from triggering factor 1 to triggering factor 4.

Next, an example of the tone generator processing will be described with reference to FIG. 11. First, at step S41, a determination is made as to which of "12 kHz", "24 kHz" and "48 kHz" has been selectively input by the user via the panel screen as control data for controlling the waveform read sampling frequency. If "12 kHz" has been input, predetermined preparations (such as setting of the number of tone generating channels to be used, setting of order in which arithmetic operations are performed in waveform generating processing and preparation of an output buffer in the RAM 5) corresponding to the selected 12 kHz read frequency are made at step S42, and the waveform generating processing is actually executed using the 12 kHz read frequency at step S43.

Typically, the waveform generating processing comprises a series of the following processes:

(1) Reading process where the original waveform data written in the waveform storing region after having been read out from the hard disk device 10 are sequentially read out from the RAM 5 in accordance with the integer portion of each read address obtained by accumulating the frequency number at a pitch according to the selected read sampling frequency;

(2) Interpolating process where the read-out waveform data are interpolated in accordance with the decimal fraction portion of the read address;

(3) Digital filtering process where control is performed over the frequency characteristics of the interpolated waveform data derived from the interpolating process;

(4) Tone volume controlling process where the waveform data having undergone the filtering process are multiplied by tone volume envelope data; and (5) Mixing process where the tone waveform data generated in the individual tone generating channels through the processes mentioned at items (1) to (4) above are mixed together.

Figure 14:
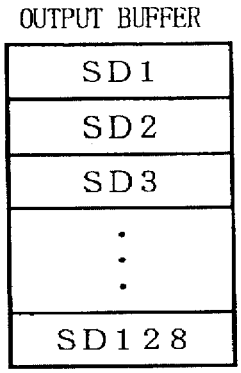
FIG. 14 shows examples of storing regions in an output buffer.

Upon completion of such waveform generating processing at step S43 of the tone generator processing, a reproduction reserving process is executed at step S44, where the resultant tone waveform data are written into the output buffer of the RAM 5 and reserved in the DMA circuit 11 for reproduction in the next time section. FIG. 14 shows a manner in which the tone waveform data are written in the output buffer. As shown, the output buffer has regions each storing one of 128 samples of the tone waveform data SD1 to SD128.

Figure 11:
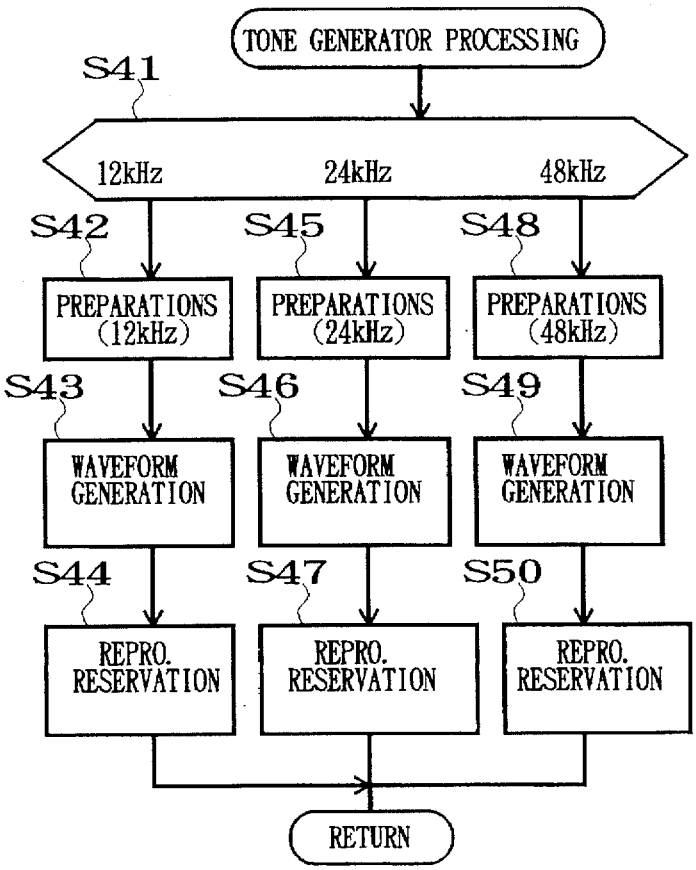
FIG. 11 is a flowchart showing one example of tone generator processing executed by the CPU.

If "24 kHz" has been input as determined at step S41 of FIG. 11, predetermined preparations corresponding to the selected 24 kHz read frequency are made at step S45 in a similar manner to step S42, waveform generating processing is executed using the 24 kHz read frequency at step S46 in a similar manner to step S43, and a reproduction reserving process is executed at step S47 in a similar manner to step S44.

If "48 kHz" has been input as determined at step S41 of FIG. 11, predetermined preparations corresponding to the selected 48 kHz read frequency are made at step S48 in a similar manner to step S42, waveform generating processing is executed using the 48 kHz read frequency at step S49 in a similar manner to step S43, and a reproduction reserving process is executed at step S50 in a similar manner to step S44.

Figure 12:
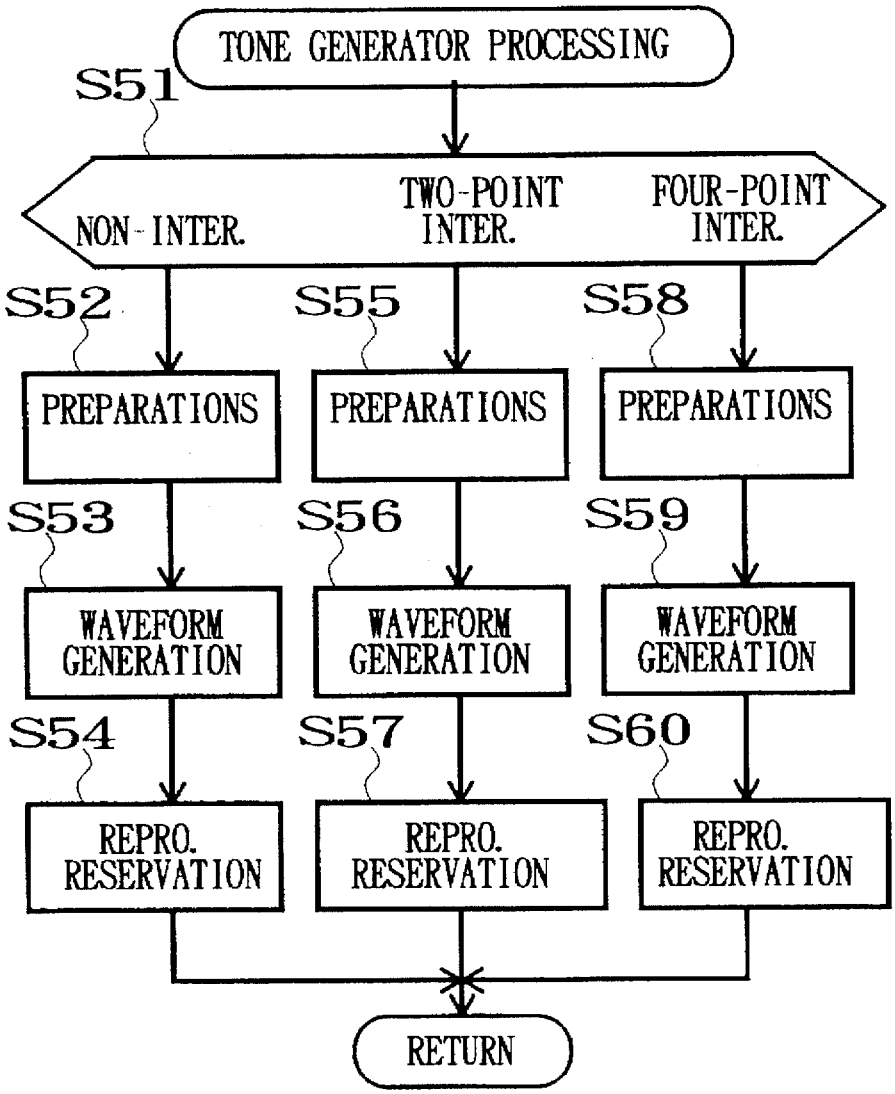
FIG. 12 is a flowchart showing another example of the tone generator processing executed by the CPU.

FIG. 12 shows another example of the tone generator processing. At first step S51, a determination is made as to which "non-interpolation", "two-point interpolation" and "four-point interpolation" has been selectively input by the user via the panel screen as the control data for controlling the interpolating process. If "non-interpolation" has been input as determined at step S51, predetermined preparations corresponding to the input "non-interpolation" condition are made at step S52, which include making a decision to not perform the interpolating process in setting the order of arithmetic operations to be performed in waveform generating processing. Then, waveform generating processing is actually executed at step S53 in a similar manner to the tone generator processing of FIG. 11 but with no interpolating process executed, and a reproduction reserving process is executed at step S54 in a similar manner to the tone generator processing of FIG. 11.

If "two-point interpolation" has been input, predetermined preparations corresponding to the input "two-point interpolation" condition are made at step S55, which include making a decision to perform a two-point interpolation process in setting the order of arithmetic operations to be performed in waveform generating processing. Then, waveform generating processing is actually executed at step S56 in a similar manner to the tone generator processing of FIG. 11 but accompanied by the two-point interpolation process, and then a reproduction reserving process is executed at step S57 in a similar manner to step S54.

If "four-point interpolation" has been input, predetermined preparations corresponding to the input "four-point interpolation" are made at step S58, which include making a decision to perform a four-point interpolating process in setting the order of arithmetic operations to be performed in waveform generating processing. Then, waveform generating processing is actually executed at step S59 in a similar manner to step S56 but accompanied by the four-point interpolating process, and then a reproduction reserving process is executed at step S60 in a similar manner to step S57.

Thus, in the examples of the tone generator processing shown in FIGS. 11 and 12, the tone generating processing is executed with the content controlled by the control data entered via the screen panel within a range set by the range designating data stored in the register PSEL. When the operation clock of the CPU used is slow, the read sampling frequency is designated to a low frequency so as to secure a sufficient number of simultaneously generated tones. While each of these examples makes a determination on only one sort of control data, the determination may of course be made on plural sorts of control data entered via the panel screen so that the wave generating processing is executed with the content based on the plural sorts of control data.

Figure 13:
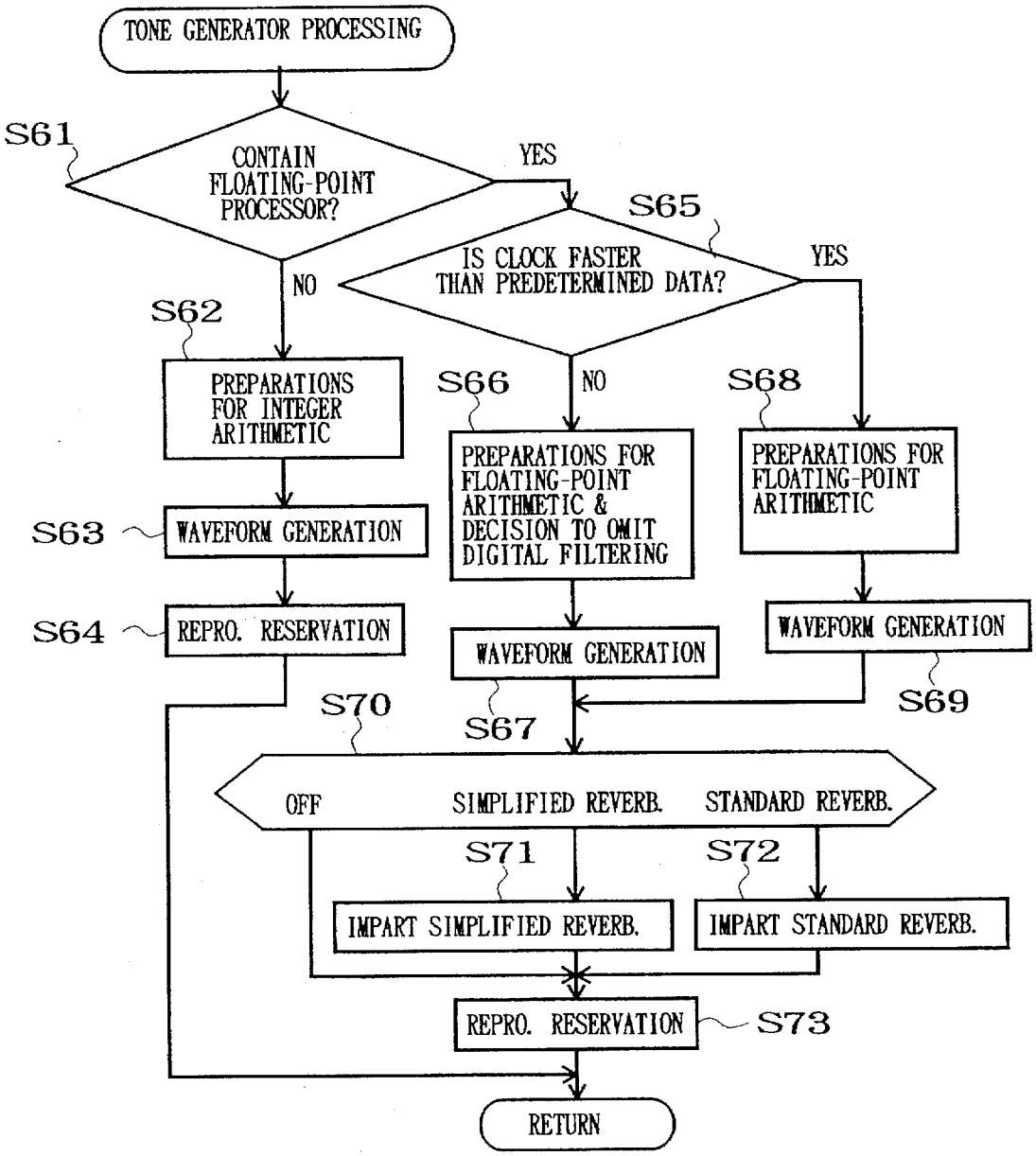
FIG. 13 is a flowchart showing yet another example of the tone generator processing executed by the CPU.

FIG. 13 shows yet another example of the tone generator processing, where at first step S61, it is determined whether or not the CPU 3 is of the type containing an arithmetic processor for floating-point arithmetic operations on the basis of the type data stored in the register PT. If answered in the negative at step S61, predetermined preparations are made at step S62 depending on the type, which include a preparation to execute a waveform generating program composed of integer arithmetic instructions. After the preparations, a waveform is generated at step S63 by executing the waveform generating program composed of integer arithmetic instructions, and then a reproduction reserving process is executed at step S64 in a similar manner to the above-mentioned.

If answered in the affirmative at step S61, it is determined at step S65 whether the operation clock of the CPU 3 is faster than a predetermined rate, on the basis of the operation clock data stored in the register OC. With a negative determination, predetermined preparations are made at step S66 depending on the operation clock, which include a preparation to execute a waveform generating program composed of floating-point arithmetic instructions and a decision to omit execution of the digital filtering process in setting the computing order of the waveform generation. Following this, a waveform is generated at step S67 by executing the waveform generating program composed of floating-point arithmetic instructions while omitting the digital filtering process, and then the processing goes to step S70. If the operation clock of the CPU 3 is faster than the predetermined rate as determined at step S65, predetermined preparations are made at step S68 depending on the operation clock, which include a preparation to execute the waveform generating program composed of floating-point arithmetic instructions but do not include a decision to omit execution of the digital filtering process. Following this, a waveform is generated at step S69 by executing the waveform generating program composed of floating-point arithmetic instructions, and then the CPU goes to step S70.

At step S70, a determination is made as to which of "off", "simplified reverberation" and "standard reverberation" has been selectively input by the user via the panel screen as control data for controlling the waveform read sampling frequency. If "off" has been input, the processing goes directly to step S73 to execute a reproduction reserving process similarly to the above-mentioned. If "simplified reverberation" has been input, the processing goes to step S71, where a low-grade simplified reverberation effect is imparted to the generated waveform by executing an effect imparting program composed of floating-point arithmetic instructions with part of the algorithm omitted. After this, the reproduction reserving process is executed at step S73. If "standard reverberation" has been input, the processing goes to step S72, where a high-grade simplified reverberation effect is imparted to the generated waveform by executing an effect imparting program composed of floating-point arithmetic instructions without omitting any part of the algorithm. After this, the reproduction reserving process is executed at step S73, and the CPU returns to the main routine.

As described, in in the example of the tone generator processing shown in FIG. 13, the tone generating processing is executed with the content controlled by a combination of the data in the registers PT and OC indicative of presence/absence of the arithmetic processor and the CPU's operation clock, respectively, and the control data entered via the screen panel within a range specified by the range designating data stored in the register PSEL. By performing control such that a different sort of instructions are used, as instructions composing the tone generating processing programs, depending on the detected type of the CPU, the processing can be executed at high speed using a sort of instructions most suitable for high-speed operation of the CPU employed.

The reason why the reverberation imparting process can not be selected in the case where the CPU does not contain a floating-point arithmetic processor is that the reverberation imparting process has to perform floating-point multiplications at high speed.

The software tone generator described above allows the CPU to execute the tone generating processing with the content controlled depending on the computing capability of the CPU. Thus, the tone generating processing can be executed in a manner most suitable for the CPU's computing capability, so that it is possible to always generate tones of highest possible quality.

The operational timing shown in FIG. 2 may be modified optionally without departing from the principle of the present invention. Time sections defined by time points T1, T2, . . . may be modified optionally, and the occurrence timing of triggering factor 2 need not coincide with these time points.

While in the above-mentioned preferred embodiment, the CPU's operation clock and type (presence/absence of an arithmetic processor contained in the CPU) are detected as performance factors determining the CPU's computing capability, presence/absence of an instruction or data cache memory in the CPU may be detected in place of or in addition to the operation clock and type.

Further, the preferred embodiment has been described above as detecting the CPU's performance so as to control the content of the tone generating processing in accordance with the detected performance. Alternatively, the CPU's computing capability may be detected by causing the CPU to actually execute a benchmark test to check its capability for floating-point or integer arithmetic operations, so as to control the content of the tone generating processing on the basis of the detected results.

Furthermore, while the preferred embodiment has been described above as controlling the sampling frequency for reading out original waveform data, interpolation, digital filtering or reverberation, any other suitable factor than the named may be controlled.

Furthermore, in the preferred embodiment described above, the read sampling frequency and interpolation are controlled selectively on the basis of the control data entered via the panel screen within a range defined by the range designating data in the register PSEL, the digital filtering process is controlled uniformly on the basis of the operation clock data in the register OC, and the reverberation is controlled on the basis of both the type data in the register PT and the control data entered via the panel screen. However, in an alternative, the read sampling frequency and interpolation may be controlled uniformly on the basis of the data in the register PT or OC, or controlled on the basis of both the data in the register PT or OC and the control data entered via the panel screen. Also, the digital filtering process may be controlled selectively on the basis of the control data entered via the panel screen, or controlled on the basis of both the data in the register PT or OC and the control data entered via the panel screen, and the reverberation may be controlled uniformly only on the basis of the data in the register PT or OC, or controlled selectively only on the basis of the control data entered via the panel screen.

Moreover, any other application software program (such as karaoke software, game software or sequencer software for automatic performance) may be executed concurrently with the above-described tone generating processing programs, by use of a same CPU. In such a case, it is preferable to set the above-mentioned control data taking into account a load imposed on the CPU by the other application software program.

Moreover, while the preferred embodiment has been described above as detecting the performance of the CPU immediately after a start of the main routine, the CPU's performance may be detected at other suitable timing (for example, when a command for performance detection is input from the keyboard 8). Further, although the preferred embodiment has been described above in relation to the case where the present invention is applied to a software tone generator employing a personal computer, the present invention may also be applied to another type software tone generator which employs a general-purpose computer rather than a personal computer or where the tone generating processing is executed by a CPU provided in an electronic music instrument.

Furthermore, the present invention may be applied to any other tone generator than the software tone generator. The likelihood of the same tone generating processing programs being executed by arithmetic processors of different computing capabilities does also exit in the case where the programs are shared among plural types of tone generating devices containing respective variably programmable DSPs, and the present invention may be applied to such DSP-containing tone generating devices.

As has been set forth so far, the present invention is applicable to not only tone generating devices based on a software tone generator but also other type tone generating devices, such as one containing a variably programmable DSP, where tone generating processing is not necessarily executed by an arithmetic processor of constantly same computing capability and allows the arithmetic processor to execute the tone generating processing with the content controlled on the basis of the performance of the processor. Therefore, the present invention allows a sufficient number of tones to be simultaneously generated even when the arithmetic unit or computing means employed has a relatively low computing capability, and also allows the tone generating processing to be executed at high speed using, as instructions composing the processing programs, instructions most suitable for high-speed operation of the arithmetic unit.

By thus executing the tone generating processing in a manner most suitable for the computing capability of each arithmetic unit employed, the present invention can always generate tones of highest possible quality.

What is claimed is:

1. A tone generating device using a processor device to execute tone generating processing comprising:

detecting means for detecting computing capability of said processor device; and control means for, depending on the computing capability detected by said detecting means, controlling content of the tone generating processing to be executed by said processor device, wherein said processor device executes the tone generating processing with the content controlled by said control means.

2. A tone generating device as claimed in claim 1 wherein said tone generating processing provides processing of one specific grade selected from among a plurality of predetermined grades, and wherein if the computing capability of said processor device detected by said detecting means is below a predetermined level, said control means executes at least one of control to select processing of a lower grade as the tone generating processing and control to omit execution of a part of the tone generating processing.

3. A tone generating device as claimed in claim 1 wherein said control means executes control such that depending on the computing capability detected by said detecting means, different instructions are used as instructions composing a specific tone generating processing program.

4. A tone generating device as claimed in claim 1 wherein said detecting means detects an operation clock of said processor device as the computing capability thereof.

5. A tone generating device as claimed in claim 1 wherein said detecting means detects the type of said processor device as the computing capability thereof.

6. A tone generating device as claimed in claim 1 wherein said detecting means detects the computing capability of said processor device by said processor device executing a test program.

7. A tone generating device as claimed in claim 1 wherein said detecting means detects the computing capability of said processor device by said processor device reading out performance-indicating data written in a predetermined storing region.

8. A tone generating device as claimed in claim 1 wherein said detecting means detects whether or not said processor device is of a type that contains an arithmetic processor for executing a predetermined sort of computing instructions at high speed.

9. A tone generating device as claimed in claim 1 wherein said control means controls a sampling frequency at which waveform data are read out.

10. A tone generating device as claimed in claim 1 wherein said control means controls an interpolation process.

11. A tone generating device as claimed in claim 1 wherein said control means controls a digital filtering process.

12. A tone generating device as claimed in claim 1 wherein said control means controls an effect imparting process.

13. A tone generating device as claimed in claim 1 wherein said control means executes control as to whether or not an reverberation effect is to be imparted and also controls a grade of the reverberation effect if the effect is to be effected.

14. A tone generating device as claimed in claim 1 wherein said control means executes control on the basis of the operation clock of said processor device.

15. A tone generating device as claimed in claim 1 wherein said control means executes control on the basis of detection as to whether or not said processor device is of a type that contains an arithmetic processor for executing floating-point arithmetic.

16. A tone generating device using a processor device to execute tone generating processing comprising:

detecting means for detecting computing capability of said processor device;

operator means for selecting control data to be inputted to said device so as to control content of the tone generating processing to be executed by said processor device; and designating means for, depending on the computing capability detected by said detecting means, designating a range of the control data that can be selected via said operator means, wherein said processor device executes the tone generating processing with the content controlled by the control data selected via said operator means.

17. A tone generating device as claimed in claim 16 wherein if the computing capability of said processor device detected by said detecting means is above a predetermined level, said designating means allows a selection of all control data within a predetermined selectable range, but if the computing capability of said processor device detected by said detecting means is below a predetermined level, said designating means allows a selection of only some of the control data within the selectable range having a relatively low grade.

18. A tone generating device as claimed in claim 16 wherein said designating means designates a selectable range of control data to be used for controlling a sampling frequency at which waveform data are read out.

19. A tone generating device as claimed in claim 16 wherein said designating means designates a selectable range of control data to be used for controlling an interpolation process.

20. A tone generating device as claimed in claim 16 wherein said designating means designates a selectable range of control data to be used for controlling an effect imparting process.

21. A tone generating device as claimed in claim 16 wherein said designating means designates a selectable range of control data to be used for executing control as to whether or not an reverberation effect is to be imparted and also controls a grade of the reverberation effect if the effect is to be effected.

22. A tone generating device comprising:

general-purpose processor device for executing tone generating processing in accordance with a program describing said processing;

detecting means for detecting computing capability of said processor device; and control means for, depending on the computing capability detected by said detecting means, controlling content of the tone generating processing executed by said processor device in accordance with the program.

23. A method for generating a tone signal by causing a general-purpose processor device to execute a program describing predetermined tone generating processing, said method comprising:

a step of detecting computing capability of said processor device; and a step of, depending on the computing capability detected by said step of detecting, executing control to change content of the tone generating processing, so as to generate a tone signal in accordance with the changed content of the tone generating processing.

24. A machine readable recording medium containing a group of instructions to cause said machine to implement a method for generating a tone signal by causing a general-purpose processor device to execute a program describing predetermined tone generating processing, said method comprising:

a step of detecting computing capability of said processor device; and a step of, depending on the computing capability detected by said step of detecting, executing control to change content of the tone generating processing, so as to generate a tone signal in accordance with the changed content of the tone generating processing.

* * * * *